US008307862B2

(12) United States Patent
Williamson

(10) Patent No.: US 8,307,862 B2
(45) Date of Patent: Nov. 13, 2012

(54) BAG LOADER

(75) Inventor: Rhoderick John Williamson, Hamilton (NZ)

(73) Assignee: Gea Avapac Limited, Hamilton (NZ)

( * ) Notice: Subject to any disclaimer, the term of this patent is extended or adjusted under 35 U.S.C. 154(b) by 1068 days.

(21) Appl. No.: 11/908,243

(22) PCT Filed: Mar. 10, 2006

(86) PCT No.: PCT/NZ2006/000041

§ 371 (c)(1),
(2), (4) Date: Sep. 8, 2008

(87) PCT Pub. No.: WO2006/096076

PCT Pub. Date: Sep. 14, 2006

(65) Prior Publication Data

US 2009/0031678 A1 Feb. 5, 2009

(30) Foreign Application Priority Data

Mar. 10, 2005 (NZ) ..... 538759

(51) Int. Cl.
*B65B 1/04* (2006.01)
*B65B 43/30* (2006.01)

(52) U.S. Cl. ..... 141/114; 141/10; 141/314; 53/284.7; 53/469

(58) Field of Classification Search ..... 141/10, 141/114, 313, 314, 317; 53/284.7, 467–469
See application file for complete search history.

(56) References Cited

U.S. PATENT DOCUMENTS

| | | | |
|---|---|---|---|
| 2,757,842 | A | 8/1956 | Gaubert |
| 3,381,447 | A | 5/1968 | Ash et al. |
| 3,631,768 | A | 1/1972 | Breidenbach |
| 4,739,910 | A | 4/1988 | Westphal et al. |

(Continued)

FOREIGN PATENT DOCUMENTS

| | | |
|---|---|---|
| CA | 2 049 707 | 2/1992 |
| DE | 1 486 061 | 2/1969 |
| EP | 0 196 702 | 10/1986 |

OTHER PUBLICATIONS

PCT International Search Report for PCT Counterpart Application No. PCT/NZ2006/000041 containing Communication relating to the Results of the Partial International Search Report, 3 pgs., (Jun. 13, 2006).

*Primary Examiner* — Gregory Huson
*Assistant Examiner* — Nicolas A Arnett
(74) *Attorney, Agent, or Firm* — Blakely, Sokoloff, Taylor & Zafman LLP

(57) ABSTRACT

The bag opening assembly (8) of an automatic bag loader includes a pair of contra-rotating air-pervious endless belts (9, 10). Opposing pinch portions (24, 25) of the belts are provided for grasping opposing sides (5*a*, 5*b*) of the hag (1) therebetween and working flights of each belt are opposingly orientated and diverge from the pinch portions. A partial vacuum is drawn in a space (41, 42) adjacent each working flight (38, 39), formed in a shoe (36, 37) which supports the thereby separate the sides to open the bag while it is advanced between the diverging working flights. At least on of the rotary members (26, 27) is displaceable and an actuator (40) is connected thereto to press the pinch portions together to grasp the sides of the unopened bag and to separate the pinch portions to release the opened bag.

20 Claims, 6 Drawing Sheets

U.S. PATENT DOCUMENTS 5,009,060 A 4/1991 Furukawa
5,279,095 A 1/1994 Müller
5,279,098 A * 1/1994 Fukuda ..... 53/451
5,715,647 A * 2/1998 Keim et al. ..... 53/374.5
6,199,351 B1 * 3/2001 Mount ..... 53/563
2004/0055250 A1 3/2004 Main et al.

* cited by examiner

BAG LOADER

CROSS-REFERENCE TO OTHER APPLICATIONS

This is a National Phase of International Application No. PCT/NZ2006/000041, filed on Mar. 10, 2006, which claims priority from New Zealand Patent Application No. 538759, filed on Mar. 10, 2005.

TECHNICAL FIELD

This invention relates to apparatus for opening and loading flat bags.

BACKGROUND ART

A wide variety of powdered or granular products are conventionally packaged in bulk in relatively large flat bags which open along one edge. These bags are usually formed of a heavy paper, but sometimes they are formed of plastic material or include a plastic liner.

U.S. Pat. No. 5,279,095 describes a machine for opening flat bags of this type with two pairs of diverging endless belts, the belts of each pair rotating in opposite directions to advance the bags transversely therebetween. Apertures are provided in the belts and a partial vacuum drawn behind the opposing diverging portions holds each side of the bag against a respective working flight of the belt, separating the sides to open the bag while it is advanced. This design addresses a drawback with prior art machines which employed vacuum cups, the contact faces of which are subject to wear, thereby affecting the seal between the cup and the bag and reducing the reliability of operation. For high-speed operation of a machine employing diverging belts in this way, it would be advantageous that the opened bag be quickly and readily released from between the belts. Also, for improved reliability, maintaining positive gripping contact with the bag throughout its movement through the bag opening assembly would be preferable to relying upon the vacuum to support the weight of the bag. Furthermore, as the bags are advanced transversely between the belts (parallel to the opening end of the bags) this machine cannot present the separated sides of the opening end of each bag on opposing sides of a fill nozzle which projects through the opening end, ready for filling the bag. This therefore requires the additional complexity of provision for a fill nozzle able to extend into each empty bag and retract when the bag is full.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided an automatic bag loader having a bag opening assembly, the bag opening assembly including:

a pair of contra-rotating air-pervious endless belts defining opposing pinch portions for grasping opposing sides of the bag therebetween;

belt-supporting means for supporting each belt for rotation thereof such that working flights of each belt are opposingly orientated and diverge from the pinch portions;

means to draw a partial vacuum in the space adjacent each working flight so as to hold the sides of the bag against the respective working flight and thereby separate the sides to open the bag while it is advanced between the diverging working flights, and characterised by at least one of said belts being displaceable for varying the spacing between the pinch portions, and an actuator operatively connected to the displaceable belt to press the pinch portions together to grasp the sides of the unopened bag and to separate the pinch portions to release the opened bag.

The working flight and pinch portions are defined by the belt-supporting means or by the path of the belt. Preferably the belt-supporting means includes a rotary member at an end of the belt and the displaceable belt is mounted to pivot about an axis of rotation of the rotary member for varying the spacing between the pinch portions. The belt-supporting means may include other rotary members but preferably includes a shoe in sliding engagement with the belt, each working flight being supported by the shoe and each pinch portion being supported by the respective end rotary member and the shoe.

The working flights and pinch portions preferably define respective substantially planar faces inclined relative to one another.

Preferably the two end rotary members are drivingly connected to synchronise their speeds, most preferably by intermeshing gears for contra-rotation.

The belts are preferably configured to raise the bag while it is opened, the bag loader further including a fill nozzle for supplying product into the bag and clamps on opposing sides of the fill nozzle, whereby the bag opening assembly separates the sides thereof while the bag is advanced between the diverging working flights, and presents the separated sides of the opening end of each bag for engagement with the clamps.

Preferably a plurality of fill nozzles, each with respective clamps, are mounted on a indexing head, the movement of the indexing head, belts and actuator being coordinated for the sequential opening and filling of the bags.

The two end rotary members are preferably offset longitudinally to present a projecting flight of the belt. The bag loader preferably further includes a transfer device for presenting the opening end of the bag to engage the projecting flight and an auxiliary roller device actuable to hold the opening end against the projecting flight for moving the opening end between the pinch portions.

Optionally the auxiliary roller device may include a freely rotating roller to hold the opening end against the projecting flight, but preferably the auxiliary roller device is driven synchronously with the pair of air-pervious belts. In the preferred embodiment the air-pervious belts include the displaceable belt and a fixed belt, the projecting flight being provided on the displaceable belt and the auxiliary roller device including:

an auxiliary roller drivingly connected by the third belt to the end rotary member of the fixed belt, and an actuator connected to the auxiliary roller for pivoting same about the axis of rotation of the end rotary member so as engage the third belt and hold the opening end against the projecting flight.

A bag feeding assembly is preferably formed to feed individual bags sequentially to an orienting assembly capable of receiving the bags and presenting the opening end to the transfer device, wherein the orienting assembly includes a rotating drum, the drum having first gripping means for selectively gripping a closed end of the bags positioned in the bag feeding assembly, the drum winding the bag thereabout and rotating the closed end to a position allowing the opening end to be engaged by the transfer device. It will be appreciated that employing a rotating drum to accumulate bags in this manner provides a space-efficient mechanism capable of aligning and indexing variable length bags.

Preferably the transfer device has second gripping means for selectively gripping the opening end of the bag, the transfer device reciprocating between a first position in which the bag is received from the drum and a second position in which the opening end of the bag is presented to the bag opening assembly.

The drum preferably has a circumference generally exceeding the maximum length of bags to be used with the loader, such that substantially the full length of the bag may be wound onto the drum without overlap and the angular rotation of the drum is controlled to accommodate bags of different lengths.

The loader includes a controller and a bag-position sensor which cooperate to control the angular rotation of the drum to correctly position the opening end for engagement with the transfer device. The rotation of the drum is preferably unidirectional, the first gripping means in the drum is released when the second gripping means on the transfer device is engaged, the drum is then rotated in the same direction as when the bag is wound onto the drum so as to position the first gripping means ready to receive a subsequent bag. Preferably the transfer device comprises a pivoting arm to which the second gripping means is fixed and which raises the bag toward the bag opening assembly.

In another aspect the invention provides a method for opening and sequential positioning of bags for filling through a fill nozzle of an automated bag loader, the method comprising:

providing bags having a closed end and which extend longitudinally to an opening in an opposing opening end;

providing a pair of contra-rotating air-pervious endless belts with opposing pinch portions for grasping opposing sides of the bag therebetween and opposingly orientated working flights diverging from the pinch portions;

drawing a partial vacuum in the space adjacent each working flight for holding each side of the bag against the respective working flight;

feeding the opening end of the bags sequentially between the pinch portions;

driving the belts to move the bags longitudinally between the belts to raise the opening end of each bag and separate the sides thereof while the bag is advanced between the diverging working flights, and presenting the separated sides of the opening end of each bag on opposing sides of the fill nozzle ready for filling.

Preferably an actuator connected to at least the first belt to displace the first belt relative to the second belt in order to release the bag.

This invention provides a bag loader which is effective and efficient in operational use, with improved reliability of operation being provided by maintaining the bag in positive gripping contact between the pinch portions throughout its movement through the bag opening assembly. For high-speed operation it advantageously permits the opened bag to be quickly and readily released from between the belts. Also, by raising the bags longitudinally between the belts the separated sides of the opening end of each bag can be presented on opposing sides of a fill nozzle which projects through the opening end, ready for filling the bag.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
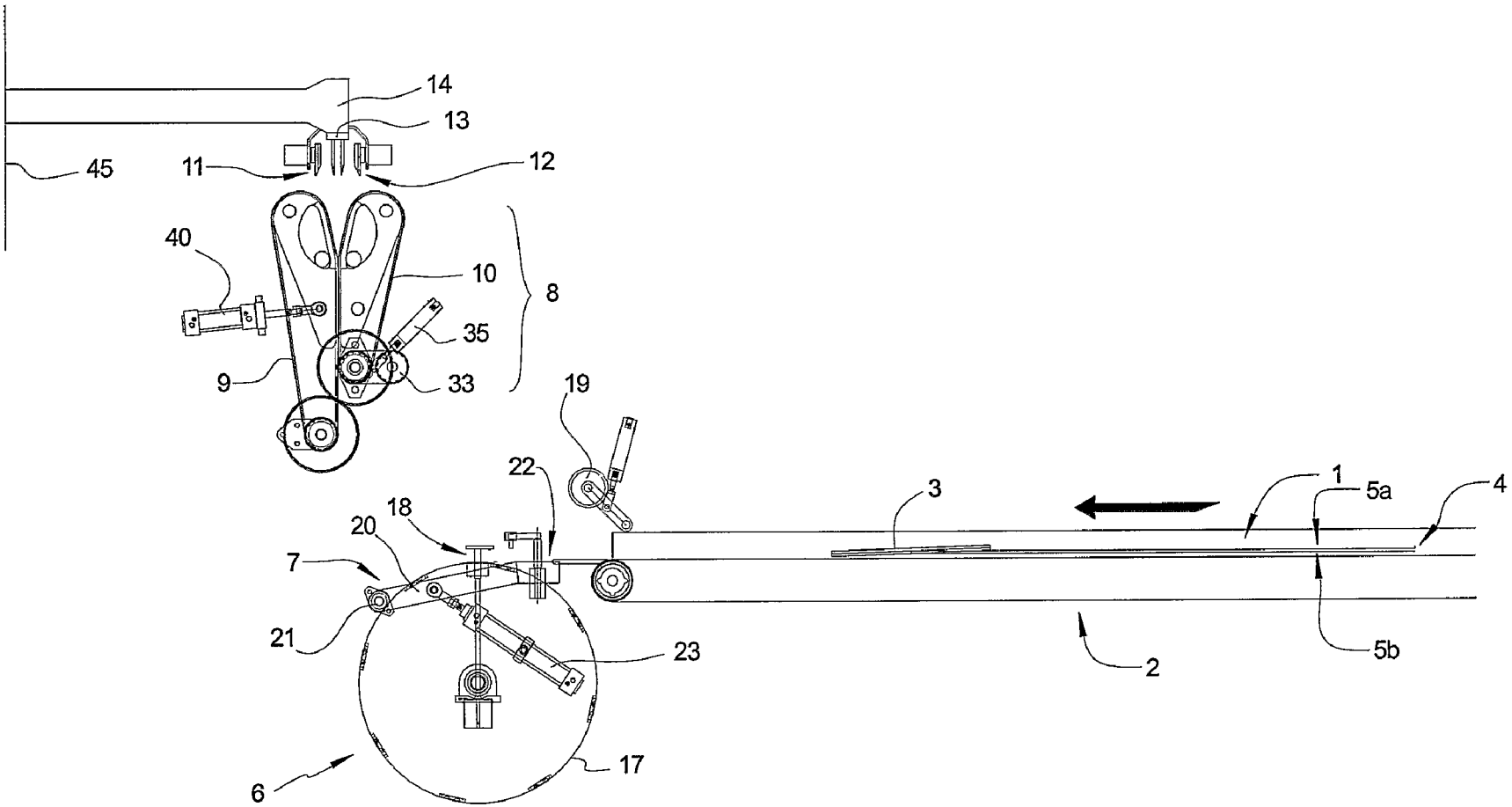
FIG. 1 is a schematic side elevation of the components of the bag loader of the present invention with the bag at a first position.

The general construction and operation of a high-speed automated bag loader according to the invention may be understood with reference to the schematic drawing FIG. 1. Bags 1 are sequentially fed along the conveyor 2 of a feeding assembly. Each bag 1 is elongate with an end block 3 closing one end and an opening along one edge at the opposing opening end 4. The bags 1 lie substantially flat upon the conveyor 2, with the end block 3 uppermost and folded against the sides 5*a*, 5*b*. The orienting assembly 6 receives the bag 1 from the conveyor 2 and moves the bag 1 to orient the opening end 4 for engagement with the transfer device 7 which presents the opening end 4 to the bag opening assembly 8. The bag opening assembly 8 includes opposed endless belts 9, 10 which raise and open the bag 1 to insert the fill nozzle 13 into the opening end 4 of the bag 1, separating the sides 5*a*, 5*b* for engagement with respective clamps 11, 12 fixed either side of the fill nozzle 13. The clamps 11, 12 and the fill nozzle 13 are mounted to an indexing head 14 which, when the bag 1 is released from the bag opening assembly 8, moves the bag 1 to the subsequent station (not shown) for filling.

It will be understood that features of this machine not described in detail will be well-known to the person skilled in the packaging machinery art. For example, the operation of the components such as clamps and rollers, may be driven by respective linear or rotary motors or like actuators. The control of these motors for coordination of the requisite steps, in particular employing feedback from position sensors, such as light emitter/receiver pairs or the like, is performed using a controller (not shown) in a well-known manner.

Figure 2:
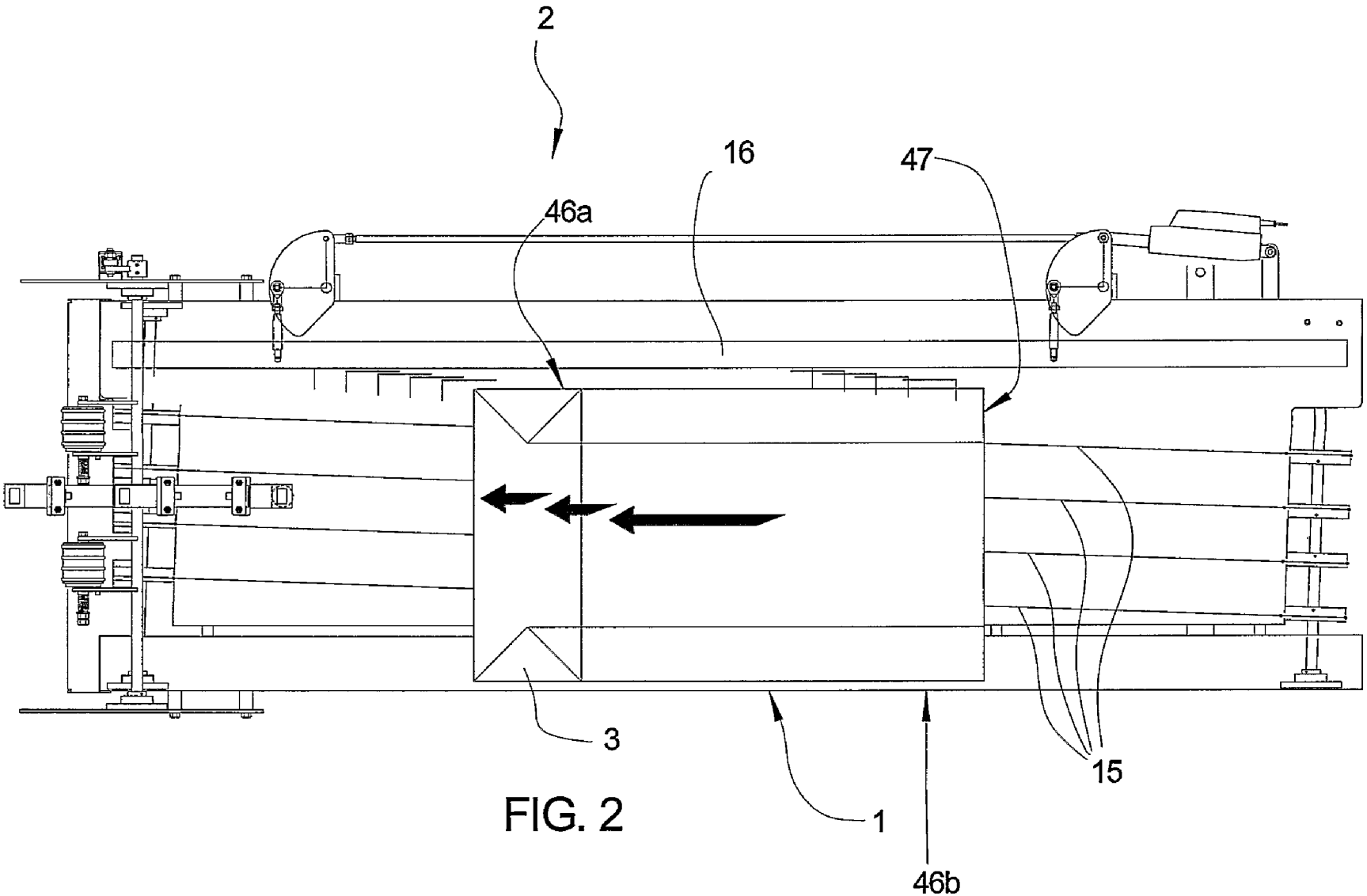
FIG. 2 is a plan view of the conveyor of FIG. 1.
Figure 5:
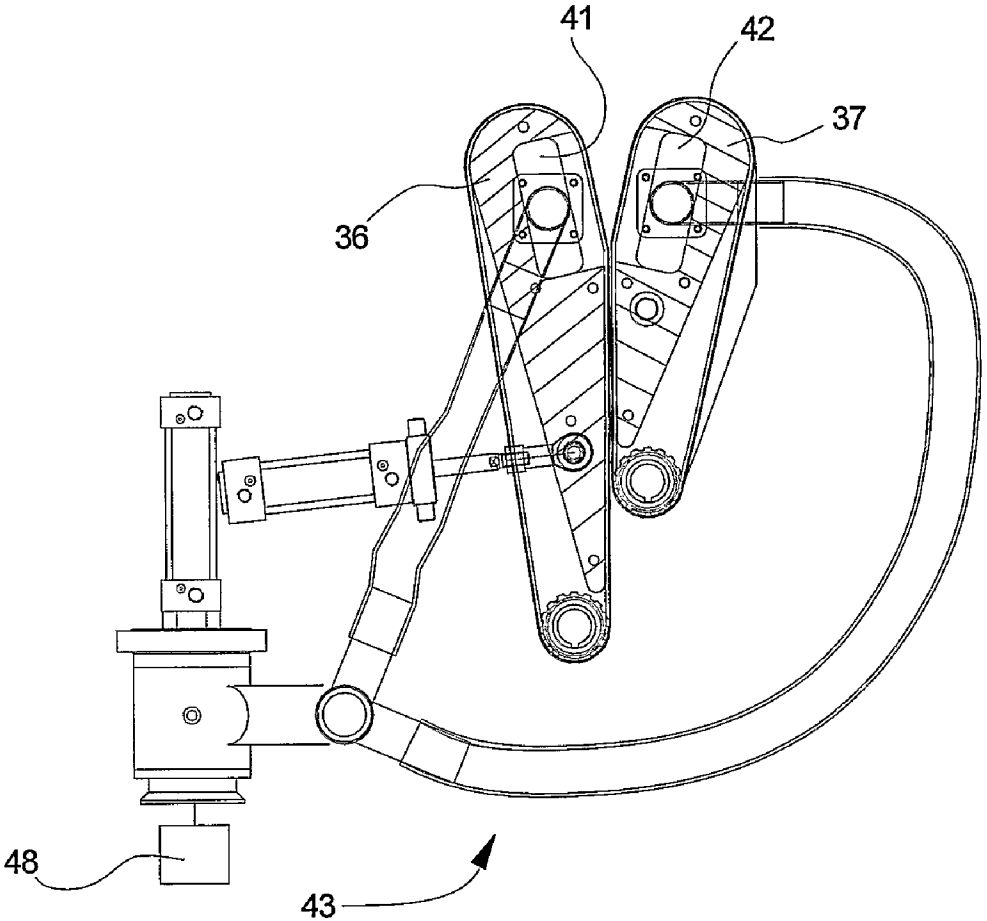
FIG. 5 is simplified side elevation showing vacuum manifold of the bag opening assembly of FIG. 1.

Conveyor 2 feeds the bag 1 horizontally and includes parallel belts 15 which are driven synchronously and inclined relative to an elongate guide 16 (as best seen in FIG. 2). In this manner a longitudinal edge 46*a* of the bag 1 is biased to slide against the guide 16 to ensure the bags 1 are properly aligned, while accommodating bags of varying widths.

The orienting assembly 6 includes a drum 17 mounted to rotate about a horizontal axis and first gripping means in the form of drum clamp 18 for gripping the bag 1 and which is fixed adjacent the periphery of the drum 17. The conveyor 2 advances the bag 1 to place the leading edge of the end block 3 into the drum clamp 18, which then grasps the bag 1. A tensioning roller 19 (shown released in FIG. 1) is positioned adjacent the drum 17 above the end of the conveyor 2 for holding the bag against the cylindrical face of the drum 17 as it is wound thereabout.

The transfer device 7 includes arms 20 mounted by horizontal pivot 21 at one end. Transfer device clamps 22 are fixed at an opposing end of the pivoting arms for gripping the opening end 4. The arms 20 are reciprocated by a linear motor 23.

Figure 3:
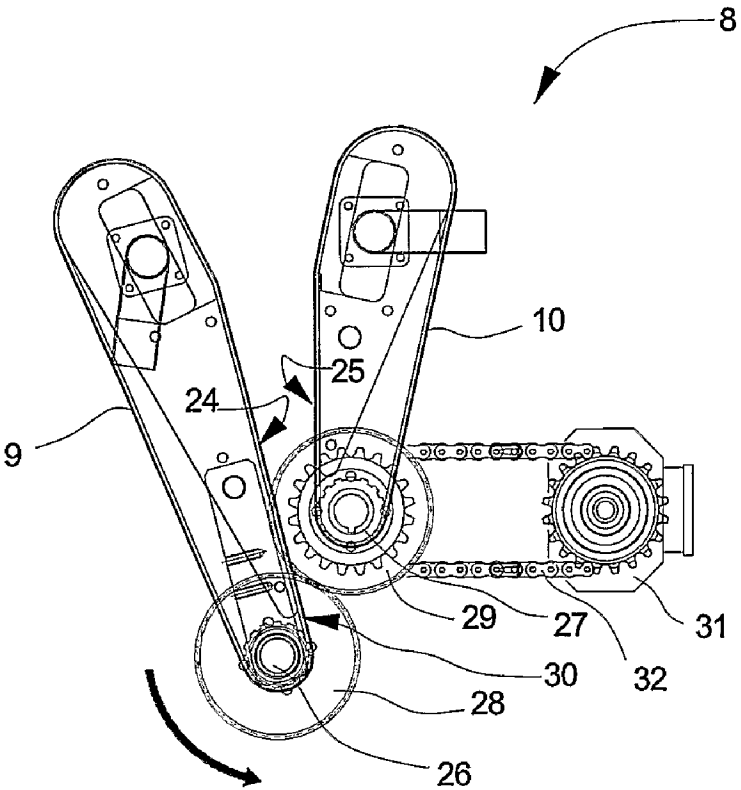
FIG. 3 is simplified side elevation showing the drive for bag opening assembly of FIG. 1.

Referring to FIG. 3, the bag opening assembly 8 includes a pair of contra-rotating endless belts 9, 10 defining opposing pinch portions 24, 25 for grasping opposing sides of the bag therebetween. Supporting the belts 9, 10 at the lower ends thereof are rotary members in the form of end rollers 26, 27 connected by gears 28, 29 to synchronise their speeds and driven by motor 31 through chain 32. The end roller 26 is offset longitudinally below the end roller 27 to present a projecting flight 30 of the belt 9 for engagement with the opening end 4 of the bag.

Fixed adjacent the end roller 27 is an auxiliary roller device 44 including an auxiliary roller 33 mounted such that the axis thereof pivots about the axis of end roller 27. An actuator 35 connected to the auxiliary roller 33 controls its pivoting movement about the axis of the end roller 27. A third or auxiliary belt 34 of the bag opening assembly 8 drivingly connects the end roller 27 to the auxiliary roller 33.

The end of the belts 9, 10 opposing the end rollers 26, 27 are supported in sliding engagement with shoes 36 and 37 respectively. The shoes 36, 37 define working flights 38, 39 which are planar and diverge from the pinch portions 24, 25. The opposing inner faces of the belts 9, 10 are convex, and include the pinch portions 24, 25 which lie below the adjacent working flights 38, 39. The pinch portions 24, 25 are generally planar, being supported between the lower end rollers 26, 27 and the lower planar faces of the shoes 36, 37. The working flights 38, 39 are also substantially planar, lying in a plane inclined to that of the pinch portions 24, 25. The belt 9 is mounted for selective displacement away from the belt 10 to enable engagement and release of the bags 1 between the pinch portions 24, 25. The shoe 36 is mounted to pivot about the axis of rotation of the end roller 26, the pivoting movement of the belt 9 being controlled by an actuator 40.

The space 41, 42 in each shoe 36, 37 adjacent each belt 9, 10 is connected by a manifold 43 to a vacuum supply 48 (shown schematically). Apertures (not shown) are provided in the belts 9, 10 for the passage of air therethrough. A partial vacuum is drawn in the space 41, 42 adjacent each belt 9, 10 so as to hold each side of the bag against the respective belt and separate the sides 5*a*, 5*b* to open the bag while it is advanced along the working flights 38, 39 upward to the fill nozzle 13.

Preferably a plurality of filling nozzles 13 are mounted on an indexing head 14 and one bag-opening assembly 30 is positioned either side of the nozzle 13. When each bag is fastened by the nozzle clamps 11, 12 the head 14 is indexed about an upright axis 45 to allow a bag to be loaded to the next nozzle 13 for high-speed operation.

Figure 7:
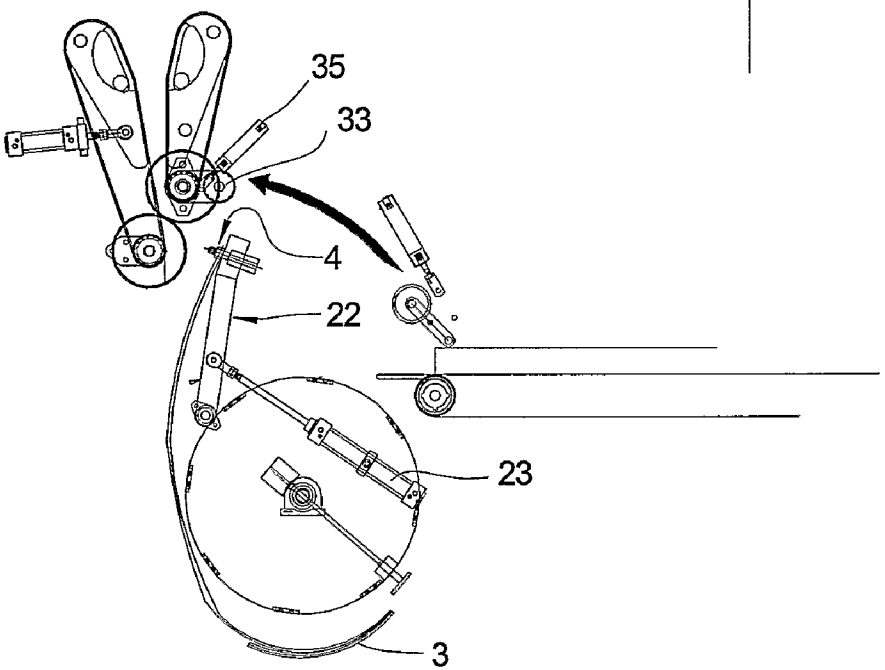
FIG. 7 is a side elevation of the bag loader of FIG. 1 with the bag at a third position.

The operation of the machine is now described with particular reference to FIGS. 1, 6, 7 and 8 which show sequential steps in the operation of the bag loader. As shown in FIG. 7, the base block 3 of the bag 1 is fed from the conveyor 2 generally tangentially to the cylindrical face of the drum 17 between the open jaws of the drum clamp 18. The drum clamp 18 is then actuated to grasp the bag 1 and the tensioning roller 19 is engaged with the upper side 5*a* of the bag 1 (as shown in FIG. 2) to maintain tension in the bag 1 as it is wound onto the drum 17. With the sides of the bag 1 thus made to conform tightly to the cylindrical face of the drum 17 the bag 1 is thereby accurately oriented for subsequent operations. The drum 17 rotates the bag 1 counter clockwise until the opening end 4 is positioned for engagement by the transfer device 7; in this manner bags of varying length are readily accommodated.

With the bag 1 positioned with the opening end 4 received in the transfer device clamps 22, the transfer device clamps 22 are engaged. The drum clamp 18 and tensioning roller 19 are released and the drum 17 rotated counter clockwise as shown in FIG. 7, ready for the next bag 1. The transfer device clamps 22 are then pivoted counter clockwise (through position 22' shown in FIG. 7) so as to present the opening end 4 to the bag opening assembly 8. The arms 20 then return, this reciprocating cycle being repeated for each bag 1.

Figure 4B:
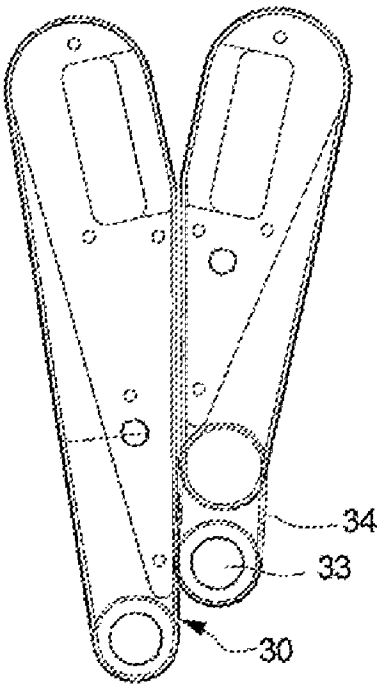
FIG. 4*a-b* are side elevations showing successive stages of operation of the bag opening assembly of FIG. 1.
Figure 4A:
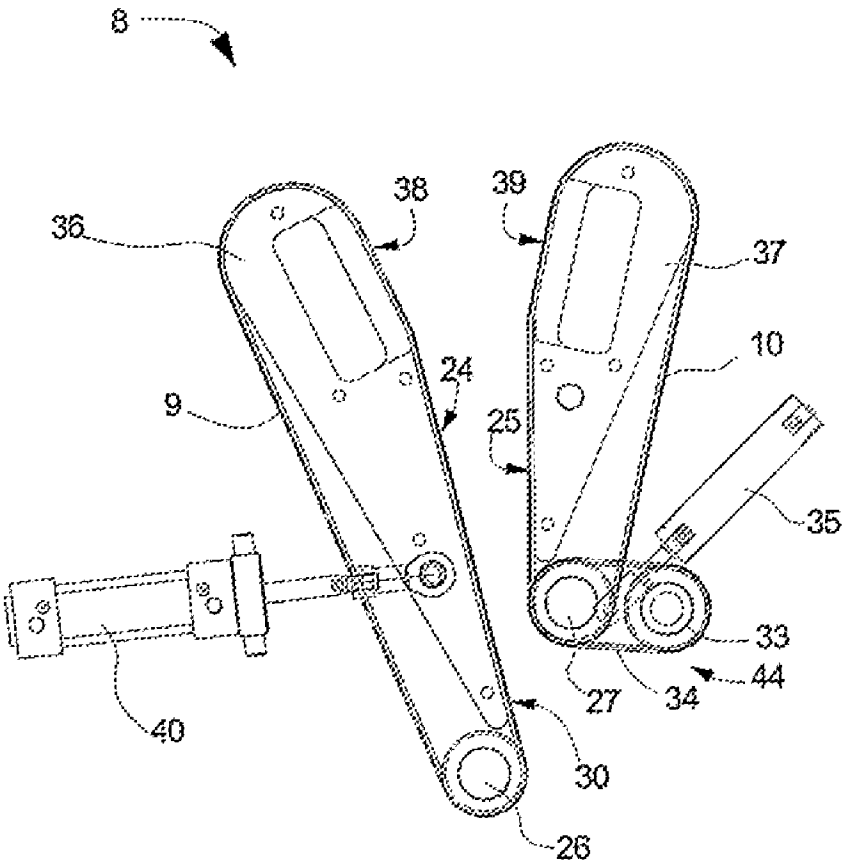
Figure 6:
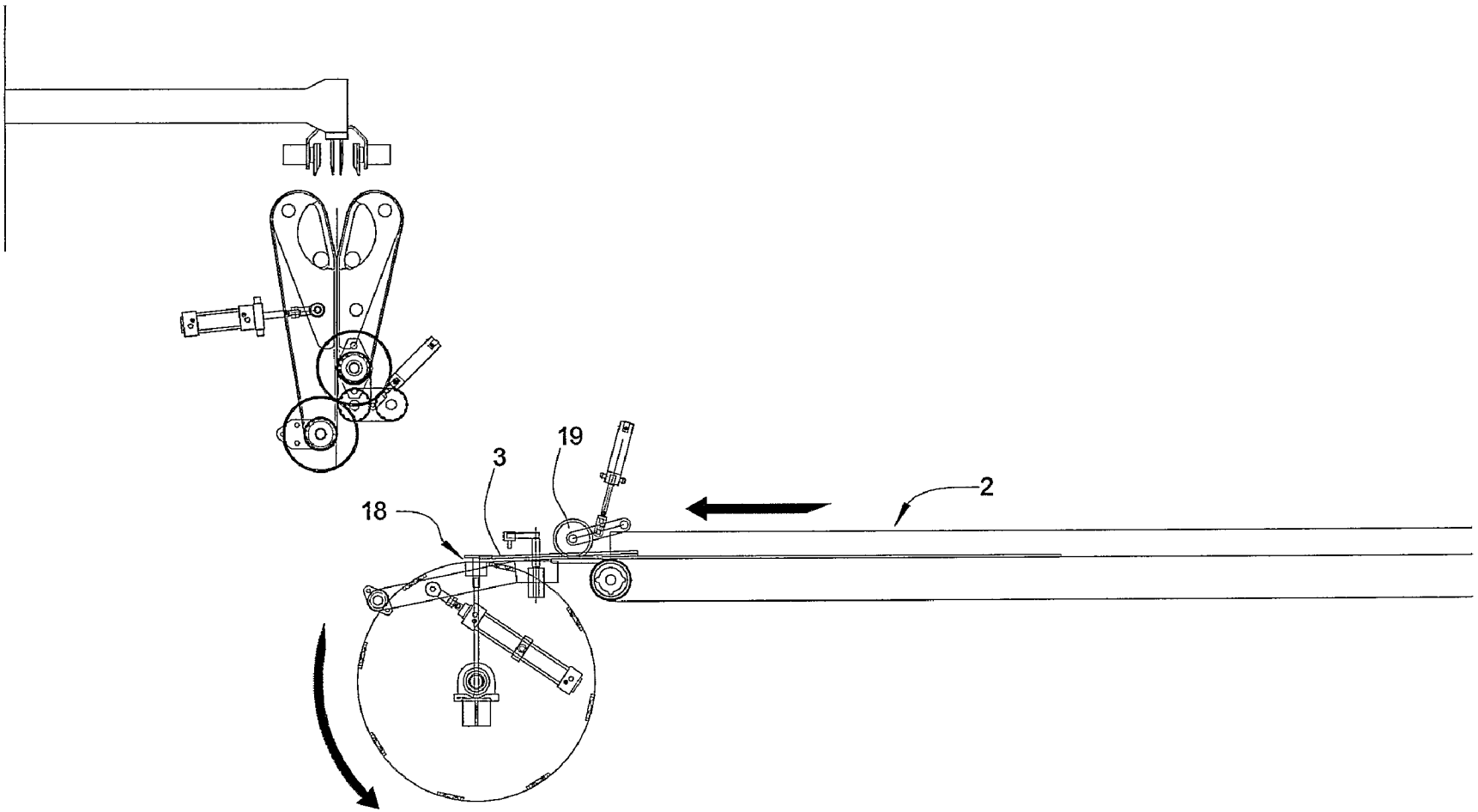
FIG. 6 is a side elevation of the bag loader of FIG. 1 with the bag at a second position.
Figure 8:
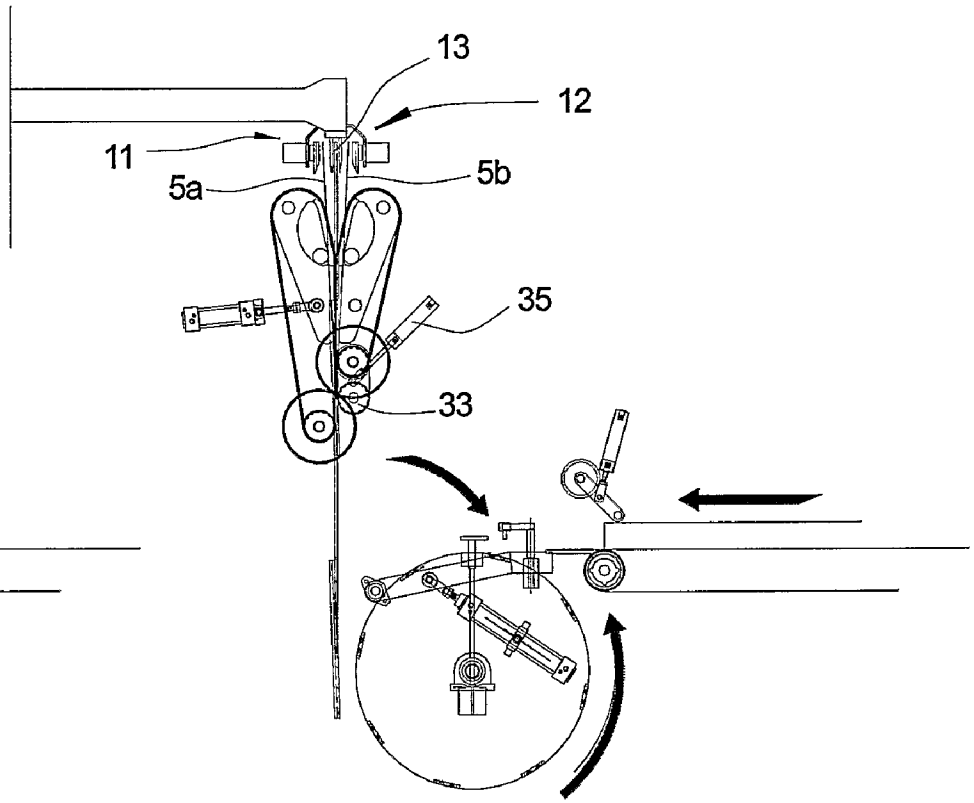
FIG. 8 is a side elevation of the bag loader of FIG. 1 with the bag at a fourth position.

When positioned ready to receive the bag 1 from the transfer device 7, the pinch portions 24, 25 of the bag opening assembly 8 are separated (as shown in FIGS. 4*a* and 7), the actuators 40 and 35 being retracted. When the opening end 4 is presented toward the projecting flight 30, actuator 40 is extended to pivot the displaceable belt 9 toward fixed belt 10 and actuator 35 is extended to pivot the auxiliary roller 33 and engage the auxiliary belt 34 with the side 5*b* of the bag 1 (as shown in FIGS. 4*b* and 8). The clamps 22 of the transfer device 7 are released and with the auxiliary belt 34 holding the bag 1 against the projecting flight 30 of the belt 10 as it is driven synchronously with the belts 9, 10 the opening end 4 is thereby driven between the pinch portions 24, 25. As a result of having passed through the orienting assembly 6, the longitudinal edges 46*a*, 46*b* of the bag 1 are accurately aligned with the direction of travel of the belts 9, 10 orthogonal to the opening edge 47.

Continued driving of the belts 9, 10 raises the bag 1 between the pinch portions 24, 25 to the diverging working flights 38, 39 against which the sides 5*a*, 5*b* are held by suction. The separated sides 5*a*, 5*b* of the opening end 4 are raised above the upper ends of the belts 9, 10, each being received on opposing sides of the nozzle 13 in a respective one of the clamps 11, 12 with the nozzle 13 extending through the opening end 4, while the lower part of the bag 1 remains held between the pinch portions 24, 25. After the clamps 11, 12 are engaged, the displaceable belt 9 is pivoted to release the base block 3 from between the pinch portions 24, 25. The head 14 is then indexed to move the bag 1 to a filling position (not shown) by rotating about axis 45.

Aspects of the present invention have been described by way of example only and it should be appreciated that modifications and additions may be made thereto without departing from the scope thereof.

The invention claimed is:

1. An automatic bag loader having a bag opening assembly, the bag opening assembly comprising:

a pair of contra-rotating air-pervious endless belts defining opposing pinch portions for grasping opposing sides of the bag therebetween;

belt-supporting means for supporting each belt for rotation thereof such that working flights of each belt are opposingly orientated and diverge from the pinch portions;

means to draw a partial vacuum in the space adjacent each working flight so as to hold the sides of the bag against the respective working flight and thereby separate the sides to open the bag while it is advanced between the diverging working flights;

wherein at least one of said belts is displaceable for varying the spacing between the pinch portions, and an actuator is operatively connected to the displaceable belt to move the displaceable belt into a position where the pinch portions press together to grasp the sides of the unopened bag and subsequently to a position where the pinch portions are separated to release the opened bag for each bag as it passes through the bag opening assembly.

2. The bag loader of claim 1 wherein the belt-supporting means includes a rotary member at an end of each belt and the displaceable belt is mounted to pivot about an axis of rotation of the rotary member for varying the spacing between the pinch portions.

3. The bag loader of claim 2 wherein the belt-supporting means includes a shoe in sliding engagement with the belt, each working flight being supported by the shoe and each pinch portion being supported by the respective end rotary member and shoe.

4. The bag loader of claim 2 wherein the two end rotary members are drivingly connected to synchronise their speeds.

5. The bag loader of claim 4 wherein the two end rotary members are directly connected by intermeshing gears for contra-rotation.

6. The bag loader of claim 2 wherein the two end rotary members are offset longitudinally to present a projecting flight of the belt.

7. The bag loader of claim 6 further including a transfer device for presenting the opening end of the bag to engage the projecting flight and an auxiliary roller device actuable to hold the opening end against the projecting flight for moving the opening end between the pinch portions.

8. The bag loader of claim 7 wherein the auxiliary roller device is driven synchronously with the pair of air-pervious belts.

9. The bag loader of claim 7 wherein the air-pervious belts include the displaceable belt and a fixed belt, the projecting flight being provided on the displaceable belt and the auxiliary roller device including:

an auxiliary roller drivingly connected by a third belt to the end rotary member of the fixed belt, and an actuator connected to the auxiliary roller for pivoting same about the axis of rotation of the end rotary member so as engage the third belt and hold the opening end against the projecting flight.

10. The bag loader of claim 1 wherein the working flights and pinch portions define respective substantially planar faces inclined relative to one another.

11. The bag loader of claim 1 wherein the belts are configured to raise the bag while it is opened, the bag loader further including a fill nozzle for supplying product into the bag and clamps on opposing sides of the fill nozzle, the clamps configured to engage with the separated sides of the opening end of each bag.

12. The bag loader of claim 11 wherein a fill nozzle, with respective clamps, is mounted on an indexing head, the movement of the indexing head, belts and actuator being coordinated for the sequential opening and filling of the bags.

13. The bag loader of claim 1 further including, a bag feeding assembly formed to feed individual bags sequentially to an orienting assembly capable of receiving the bags and presenting the opening end to the transfer device, wherein the orienting assembly includes a rotating drum, the drum having first gripping means for selectively gripping a closed end of the bags positioned in the bag feeding assembly, the drum winding the bag thereabout and rotating the closed end to a position allowing the opening end to be engaged by the transfer device.

14. The bag loader of claim 13 wherein the transfer device has second gripping means for selectively gripping the opening end of the bag, the transfer device reciprocating between a first position in which the bag is received from the drum and a second position in which the opening end of the bag is presented to the bag opening assembly.

15. The bag loader of claim 14 wherein rotation of the drum is unidirectional, the first gripping means in the drum is released when the second gripping means on the transfer device is engaged, the drum is then rotated in the same direction as when the bag is wound onto the drum so as to position the first gripping means ready to receive a subsequent bag.

16. The bag loader of claim 14 wherein the transfer device comprises a pivoting arm to which the second gripping means is fixed and which raises the bag toward the bag opening assembly.

17. The bag loader of claim 13 wherein the drum has a circumference generally exceeding the maximum length of bags to be used with the loader, such that substantially the full length of the bag may be wound onto the drum without overlap and the angular rotation of the drum is controlled to accommodate bags of different lengths.

18. The bag loader of claim 17 wherein the loader includes a controller and a bag-position sensor which cooperate to control the angular rotation of the drum to correctly position the opening end for engagement with the transfer device.

19. A method for opening and sequential positioning of bags for filling through a fill nozzle of an automated bag loader, the automated bag loader comprises a pair of contra-rotating air-pervious endless belts defining opposing pinch portions for grasping opposing sides of the bag therebetween, belt-supporting means for supporting each belt for rotation thereof such that working flights of each belt are opposingly orientated and diverge from the pinch portions, and means to draw a partial vacuum in the space adjacent each working flight so as to hold the sides of the bag against the respective working flight and thereby separate the sides to open the bag while it is advanced between the diverging working flights, the method comprising:

providing bags having a closed end and which extend longitudinally to an opening in an opposing opening end;

drawing a partial vacuum in the space adjacent each working flight for holding each side of the bag against the respective working flight;

feeding the opening end of the bags sequentially between the pinch portions;

driving the belts to move the bags longitudinally between the belts to raise the opening end of each bag and separate the sides thereof while the bag is advanced between the diverging working flights, wherein at least one of the belts is displaceable for varying the spacing between the pinch portions;

moving the displaceable belt into a position where the pinch portions press together to grasp the sides of the unopened bag and subsequently to a position where the pinch portions are separated to release the opened bag for each bag as it passes through the bag opening assembly; and presenting the separated sides of the opening end of each bag on opposing sides of the fill nozzle ready for filling.

20. The method of claim 19 including the further step of operating an actuator connected to the displaceable belt to displace the displaceable belt relative to the other belt in order to release the bag.

* * * * *